US010504666B2

(12) United States Patent
Chen

(10) Patent No.: US 10,504,666 B2
(45) Date of Patent: Dec. 10, 2019

(54) KEY STRUCTURE

(71) Applicant: LITE-ON TECHNOLOGY CORPORATION, Taipei (TW)

(72) Inventor: Chun-Lin Chen, Taipei (TW)

(73) Assignee: LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 16/027,601

(22) Filed: Jul. 5, 2018

(65) Prior Publication Data

US 2019/0019634 A1 Jan. 17, 2019

(30) Foreign Application Priority Data

Jul. 11, 2017 (CN) ..... 2017 1 0561518

(51) Int. Cl.
*H01H 13/85* (2006.01)
*H01H 3/12* (2006.01)
*H01H 13/705* (2006.01)

(52) U.S. Cl.
CPC ..... *H01H 3/125* (2013.01); *H01H 13/705* (2013.01); *H01H 13/85* (2013.01);
(Continued)

(58) Field of Classification Search
CPC ..... H01H 3/125; H01H 13/83; H01H 13/705; H01H 13/704; H01H 13/7065;
(Continued)

(56) References Cited

U.S. PATENT DOCUMENTS 6,133,538 A 10/2000 Hsu
9,455,096 B2 9/2016 Chen
(Continued)

FOREIGN PATENT DOCUMENTS

CN 201146119 Y 11/2008
CN 202363331 U 8/2012
(Continued)

OTHER PUBLICATIONS

CN Office Action dated May 17, 2019 in corresponding Chinese application (No. 201710561518.6).
(Continued)

*Primary Examiner* — Ahmed M Saeed
(74) *Attorney, Agent, or Firm* — McClure, Qualey & Rodack, LLP

(57) ABSTRACT

A key structure including a base, a pivoting structure and a cap is provided. The base includes a plate, a first limiting unit and a second limiting unit. The pivoting structure includes a first pivoting part and a second pivoting part, the first pivoting part has a connecting shaft, and the second pivoting part has a shaft hole in which the connecting shaft is received and slidable. The cap has a first pivoting unit and a second pivoting unit, one side of the first pivoting part and one side of the second pivoting part are pivotally connected to the first pivoting unit and the second pivoting unit respectively, and the other side of the first pivoting part and the other side of the second pivoting part are slidably disposed in the first limiting unit and the second limiting unit respectively.

17 Claims, 3 Drawing Sheets

(52) U.S. Cl.
CPC . *H01H 2227/028* (2013.01); *H01H 2227/036* (2013.01); *H01H 2231/002* (2013.01)

(58) Field of Classification Search
CPC ..... H01H 13/70; H01H 2215/006; H01H 2227/028; H01H 2227/036; H01H 13/85; H01H 2231/002
USPC ..... 200/5 A, 341–345
See application file for complete search history.

(56) References Cited

U.S. PATENT DOCUMENTS

| | | | | |
|---|---|---|---|---|
| 10,184,609 | B2 | 1/2019 | Yen et al. | |
| 2014/0124348 | A1* | 5/2014 | Lee | H01H 13/86 200/5 A |

FOREIGN PATENT DOCUMENTS

| | | | |
|---|---|---|---|
| CN | 203588891 | U | 5/2014 |
| CN | 104183402 | A | 12/2014 |
| CN | 104576134 | A | 4/2015 |
| CN | 205789640 | U | 12/2016 |
| CN | 106935421 | A | 7/2017 |

OTHER PUBLICATIONS

CN Office Action dated Aug. 15, 2019 in correspondence Chinese application (No. 201710561518.6).

* cited by examiner

KEY STRUCTURE

This application claims the benefit of People's Republic of China application Serial No. 201710561518.6, filed Jul. 11, 2017, the subject matter of which is incorporated herein by reference.

BACKGROUND OF THE INVENTION

Field of the Invention

The invention relates in general to a key structure, and more particularly to an ultra-thin key structure.

Description of the Related Art

A conventional key uses a scissor structure to guide a key cap to move up and down. The key cap has a first sliding portion and a first positioning portion. The bottom plate has a second sliding portion and a second positioning portion. One arm of the scissor structure has a first sliding shaft and a first pivoting shaft. The other arm of the scissor structure has a second sliding shaft and a second pivoting shaft. The first sliding shaft can be slidably disposed in the first sliding portion of the key cap. The second sliding shaft can be slidably disposed in the second sliding portion of the bottom plate.

However, when the key is pressed, the key cap is laterally displaced for an invalid course along the slide direction of the first sliding portion and is vertically displaced towards the bottom plate for an invalid course. Then, the key cap will link the scissor structure to be displaced towards the bottom plate for a valid course to press the elastomer. Thus, the key structure cannot meet the thinness requirement of the ultra-thin keyboard. Furthermore, if the invalid course is too long, valid course at corners of the key cap will be insufficient. Thus, the problems of having poor tactile sensation at corners of the key cap and having poor electrical conduction at corners of the key cap will arise.

SUMMARY OF THE INVENTION

The invention is directed to a key structure, wherein the cap has two pivoting units, and two fixing shafts can be pivotally connected between the pivoting structure and the cap, such that lateral displacement of the key can be effectively reduced. Due to the vertical valid course of the key naturally generated from the tolerance gap generated during mold manufacturing, invalid lateral displacement of the key can be reduced, such that the user's tactile sensation at corners of the cap can be improved and the problem of poor electrical conduction at corners of the cap can be resolved.

According to one embodiment of the present invention, a key structure including a base, a pivoting structure and a cap is provided. The base includes a plate, a first limiting unit and a second limiting unit. The pivoting structure is movably disposed on the base and includes a first pivoting part and a second pivoting part, wherein the first pivoting part has a connecting shaft, and the second pivoting part has a shaft hole in which the connecting shaft is received and slidable. The cap is disposed on the pivoting structure and has a first pivoting unit and a second pivoting unit, wherein one side of the first pivoting part and one side of the second pivoting part are pivotally connected to the first pivoting unit and the second pivoting unit respectively, and the other side of the first pivoting part and the other side of the second pivoting part are slidably disposed in the first limiting unit and the second limiting unit respectively.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
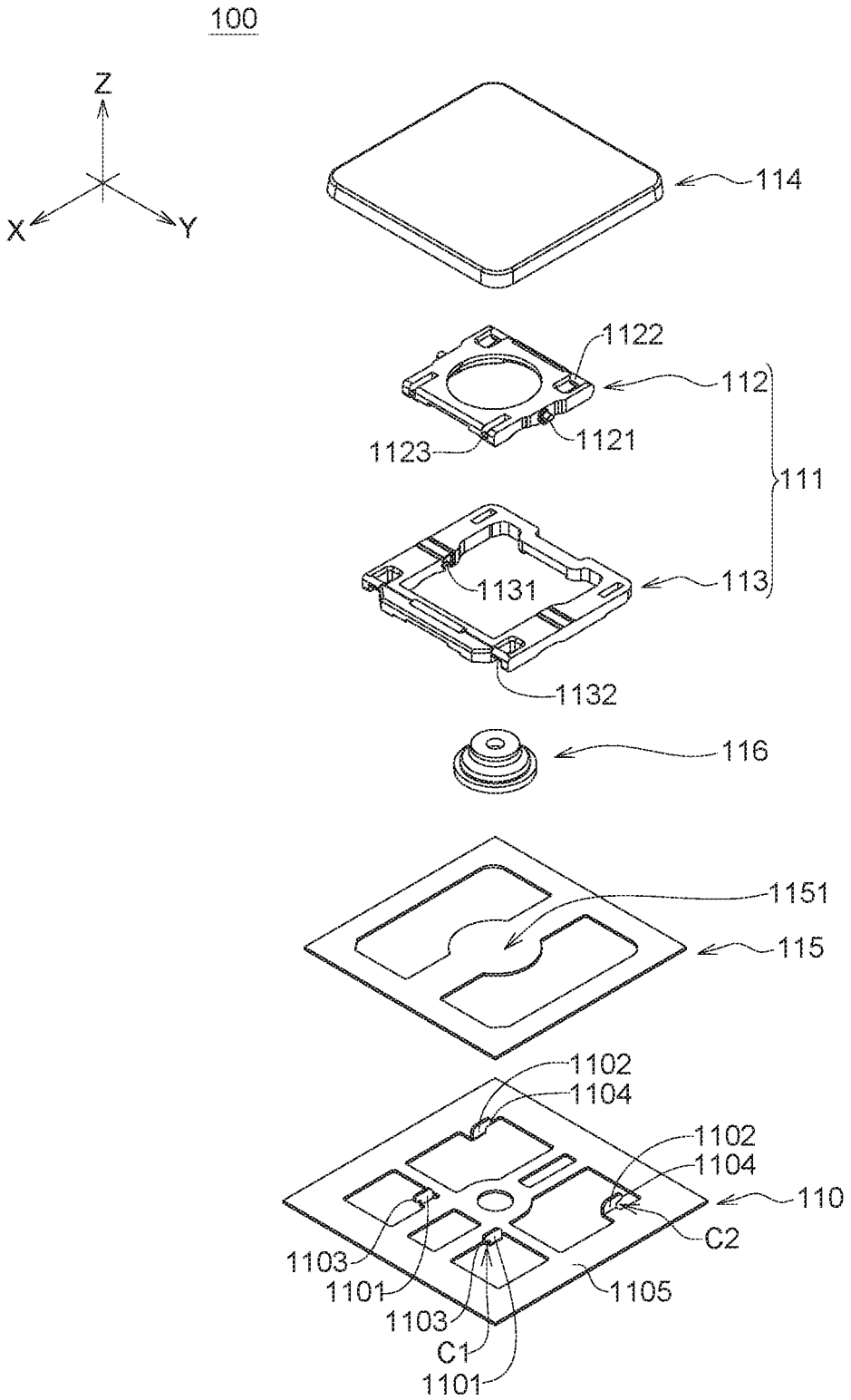
FIG. 1 is an explosion diagram of a key structure according to an embodiment of the invention.

Detailed descriptions of the invention are disclosed below with a number of embodiments. However, the disclosed embodiments are for explanatory and exemplary purposes only, not for limiting the scope of protection of the invention.

Refer to FIGS. 1, 2, 3A and 3B. The key structure 100 according to an embodiment of the invention includes a base 110, a pivoting structure 111 and a cap 114. The cap 114 is disposed on the pivoting structure 111. The pivoting structure 111 is movably interposed between the cap 114 and the base 110. The base 110 includes a plate 1105, a first limiting unit 1101 and a second limiting unit 1102. The plate 1105 is located on a plane defined by an X-axis and a Y-axis. The first limiting unit 1101 and the second limiting unit 1102 extend towards a positive Z-axis direction from the plate 1105, and the X-axis and the Y-axis are respectively orthogonal with the Z-axis.

The first limiting unit 1101 has a first sliding portion 1103 extended along a positive X-axis direction to form an L-shaped beak structure. The second limiting unit 1102 has a second sliding portion 1104 extended along a negative X-axis direction to form an L-shaped beak structure. A first receiving space C1 is defined between the first sliding portion 1103 and the plate 1105 and a second receiving space C2 is defined between the second sliding portion 1104 and the plate 1105.

The pivoting structure 111 includes a first pivoting part 112 and a second pivoting part 113. The first pivoting part 112 has a connecting shaft 1121, and the second pivoting part 113 has a shaft hole 1131 in which the connecting shaft 1121 is received and slidable. Thus, the first pivoting part 112 is pivotally connected to the second pivoting part 113 via the connecting shaft 1121 received in the shaft hole 1131.

Figure 3A:
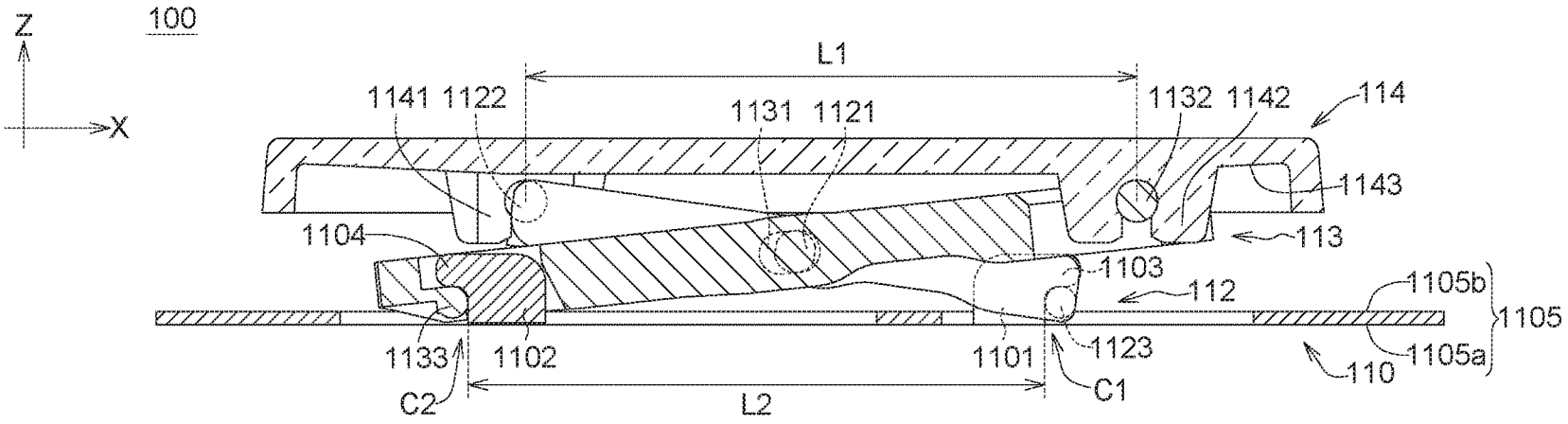
FIG. 3A is a cross-sectional view of a key structure not having been pressed according to an embodiment of the invention.
Figure 3B:
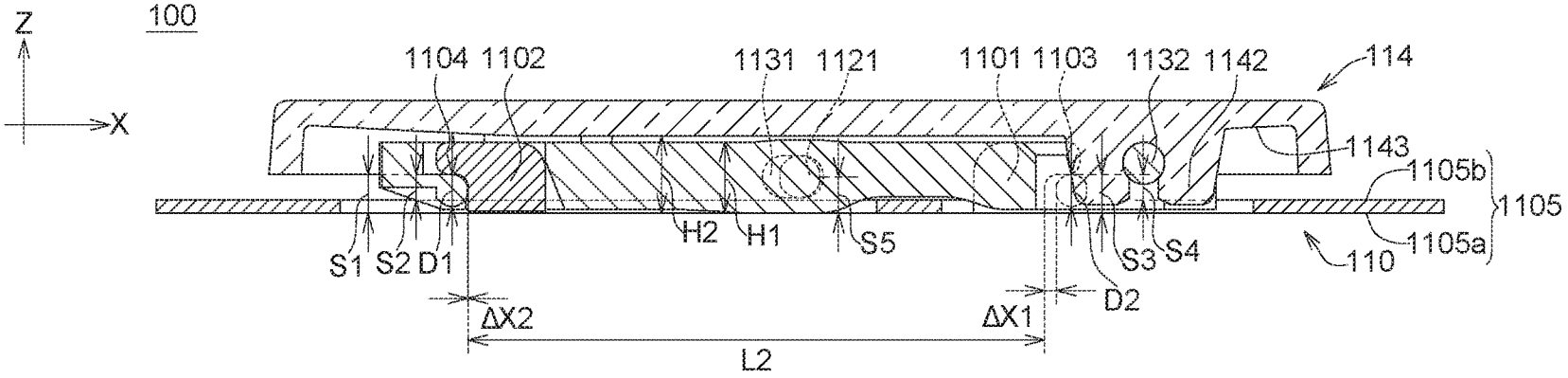
FIG. 3B is a cross-sectional view of a key structure having been pressed according to an embodiment of the invention.

Refer to FIGS. 3A and 3B. In an embodiment, the shaft hole 1131 can be a long slot, and the connecting shaft 1121 can be a cylinder. The connecting shaft 1121 can move in the long slot. The long slot can have an oval shape or a rectangular shape for limiting the moving direction of the connecting shaft 1121 to be substantially parallel to the long-axis or the long side of the long slot. In another embodiment (not illustrated), the shaft hole 1131 can be a circular slot whose size is larger than the diameter of the connecting shaft 1121. There is no need to manufacture a specific long slot as long as the tolerance gap generated during mold manufacturing between the connecting shaft 1121 and the shaft hole 1131 allows the connecting shaft 1121 to move in the shaft hole 1131.

Figure 2:
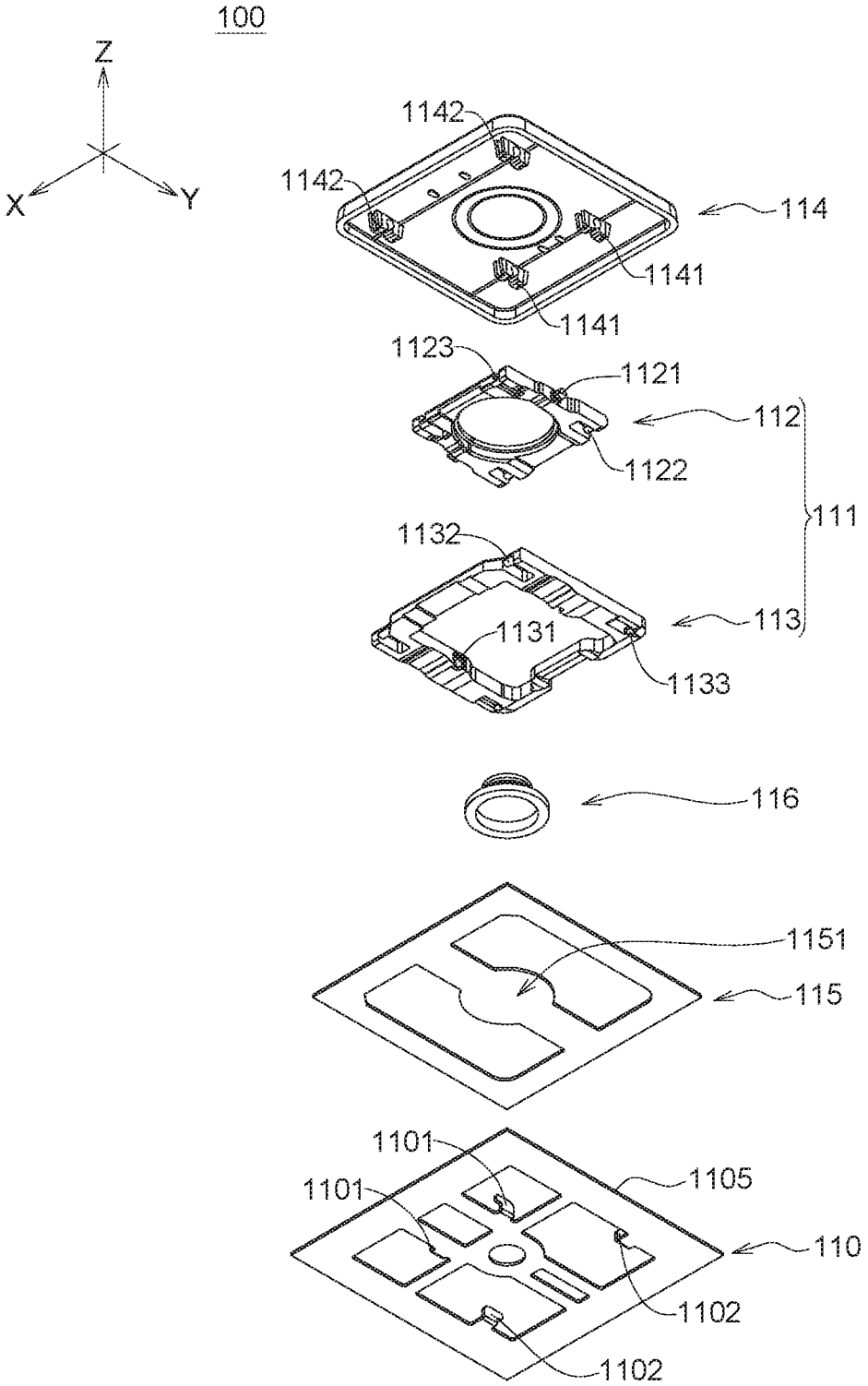
FIG. 2 is an explosion diagram of a key structure at another view according to an embodiment of the invention.

As indicated in FIGS. 1 and 2, one end of the first pivoting part 112 and one end of the second pivoting part 113 have a first fixing shaft 1122 and a second fixing shaft 1132 respectively, and the other end of the first pivoting part 112 and the other end of the second pivoting part 113 have a first sliding shaft 1123 and a second sliding shaft 1133 respectively. As indicated in FIGS. 3A and 3B, the cap 114 has a first pivoting unit 1141 and a second pivoting unit 1142 protruded from the bottom surface 1143 of the cap, the first fixing shaft 1122 and the second fixing shaft 1132 are correspondingly pivotally connected to the first pivoting unit 1141 and the second pivoting unit 1142, and the first sliding shaft 1123 and the second sliding shaft 1133 are correspondingly slidably disposed in the first receiving space C1 and the second receiving space C2.

In the present embodiment, one side of the first pivoting part 112 and one side of the second pivoting part 113 (i.e. the side closer to the cap 114) are pivotally connected to the first pivoting unit 1141 and the second pivoting unit 1142 of the cap 114 respectively, and the other side of the first pivoting part 112 and the other side of the second pivoting part 113 (i.e. the side closer to the base 110) are slidably disposed in the first limiting unit 1101 and the second limiting unit 1102 of the base 110 respectively.

It should be noted that in FIGS. 3A and 3B, when the cap 114 moves to a pressing position from a releasing position, the first sliding shaft 1123 interferes with the first sliding portion 1103 on the Z-axis such that the first sliding shaft 1123 moves for a first displacement ΔX1 along a positive X-axis direction, and the second sliding shaft 1133 interferes with the second sliding portion 1104 on the Z-axis such that the second sliding shaft 1133 moves for a second displacement ΔX2 along a negative X-axis direction or does not slide. Therefore, the cap 114 can move up and down with respect to the base 110 via the rotation of the first pivoting part 112 with respect to the second pivoting part 113.

The value of the second displacement ΔX2 can be equivalent to or approximate to 0, and therefore can be neglected. Since the value of the first displacement ΔX1 can be larger than the value of the second displacement ΔX2, the invention only requires the first sliding shaft 1123 to move along the positive X-axis direction and the second sliding shaft 1133 does not have to move along the negative X-axis direction.

Refer to FIGS. 1 and 2. The key structure 100 further includes a thin-film circuit board 115 and an elastomer 116. The thin-film circuit board 115 is disposed on the base 110 and includes a switch element 1151. The elastomer 116 is disposed on the switch element 1151 for supporting the cap 114, such that the cap 114 can move with respect to the base 110. In an embodiment, the switch element 1151 includes an upper conducting layer and a lower conducting layer (not illustrated), and the upper conducting layer and the lower conducting layer are separated by a gap. When the cap 114 is pressed, the switch element 1151 corresponding to the elastomer 116 is pressed, such that the upper conducting layer and the lower conducting layer contact each other and become electrically conducted to generate a pressing signal.

As indicated in FIG. 3B, in the Z-axis direction, a first distance S1 is formed between the first sliding portion 1103 and the bottom surface 1105*a* of plate, and a second distance S2 is formed between the first sliding portion 1103 and the top surface 1105*b* of the plate, the first sliding shaft 1123 has a diameter D1, and the diameter D1 of the first sliding shaft 1123 is between the first distance S1 and the second distance S2, that is, S2<D1<S1. In the Z-axis direction, a third distance S3 is formed between the second sliding portion 1104 and the bottom surface 1105*a* of the plate, and a fourth distance S4 is formed between the second sliding portion 1104 and the top surface 1105*b* of the plate. The second sliding shaft 1133 has a diameter D2 and the diameter D2 is between the third distance S3 and the fourth distance S4, that is, S4<D2<S3. In the present embodiment, a portion of the first sliding shaft 1123 and the second sliding shaft 1133 is substantially lower than the top surface 1105*b* of the plate and is buried in the plate 1105, such that the overall height of the pressed key structure 100 is relatively reduced.

Similarly, when the cap 114 moves to a pressing position, a portion of the first pivoting unit 1141 and the second pivoting unit 1142 (such as the bottom surface thereof) is substantially lower than the top surface 1105*b* of the plate and is buried in the plate 1105, and a portion of the first pivoting part 112 and the second pivoting part 113 (such as the bottom surface thereof) is also substantially lower than the top surface 1105*b* of the plate and is buried in the plate 1105. Therefore, the overall height of the pressed key structure 100 is relatively reduced.

Since the first sliding shaft 1123 and the second sliding shaft 1133 are buried in the plate 1105, the heights of the first limiting unit 1101 and the second limiting unit 1102 can be reduced. Refer to FIG. 3B. In an embodiment, the first limiting unit 1101 and the second limiting unit 1102 both have a first height H1 with respect to the bottom surface 1105*a* of the plate, and when the cap 114 moves to a pressing position from a releasing position, the cap bottom surface 1143 has a second height H2 with respect to the bottom surface 1105*a* of the plate, and the second height H2 is larger than the first height H1. Therefore, when the cap 114 moves to the pressing position, the bottom surface 1143 of the cap substantially does not contact the first limiting unit 1101 or the second limiting unit 1102, and will not generate noises.

In an embodiment, when the cap 114 moves to the pressing position, the center of the connecting shaft 1121 has a height S5 with respect to the bottom surface 1105*a* of the plate, and the height S5 is substantially larger than or equivalent to the first distance S1 formed between the first sliding portion 1103 and the bottom surface 1105*a* of the plate. In an embodiment, a portion of the connecting shaft 1121 can also be substantially lower than the top surface 1105*b* of the plate and be buried in the plate 1105. However, the invention does not have specific restrictions regarding the said arrangement.

In the present embodiment, since one side of the first pivoting part 112 and one side of the second pivoting part 113 are pivotally connected to the first pivoting unit 1141 and the second pivoting unit 1142 of the cap 114 respectively, a distance L1 formed between the first fixing shaft 1122 and the second fixing shaft 1132 is fixed. Since the other side of the first pivoting part 112 and the other side of the second pivoting part 113 are slidably disposed in the first limiting unit 1101 and the second limiting unit 1102 of the base 110 respectively, a distance L2 formed between the first sliding shaft 1123 and the second sliding shaft 1133 is variant. Therefore, when the cap 114 is pressed, invalid lateral displacements can be effectively reduced due to the fixed distance L1. Besides, the lateral displacement generated by the connecting shaft 1121 in the shaft hole 1131 and the variant distance L2 formed between the first sliding shaft 1123 and the second sliding shaft 1133 provide a lateral displacement required for the pressing course of the pivoting structure 111, such that invalid lateral displacements can almost be avoided when the pivoting structure 111 is displaced towards the base 110. In other words, the cap 114 can stably ascend or descend with respect to the base 110 along the Z-axis direction to a small extent.

Let an ultra-thin keyboard with a thickness of 3.0 mm be taken for example. In an embodiment of the invention, when the key structure 100 has a vertical course of 1 mm, the vertical valid course of the pivoting structure 111 is about 0.9-1 mm. In other words, the displacement of the pivoting structure 111 towards the base 110 is almost equivalent to the vertical course of the key structure 100, therefore the key structure 100 of the invention can be used in an ultra-thin keyboard of a laptop computer. The vertical course of the ultra-thin keyboard is about 0.70-1.50 mm, but such range is not restrictive in the invention.

Since the vertical course of the key structure 100 is of a millimeter level and can be generated from the tolerance gap generated during mold manufacturing, the key structure 100 can dispense with the design concept of long course. Besides, through the design of the two fixing shafts, invalid course during the pressing course of the cap can be effectively reduced. A decrease in invalid course implies an increase in the valid course of corners of the cap and an increase in user's tactile sensation. Therefore, the problems of having poor tactile sensation at corners of the cap and having poor electrical conduction at corners of the cap can be resolved.

Since the force applied to the cap 114 is uniform, the cap 114 does not tilt easily and can stably move up and down. No matter the user presses the central region, the peripheral region or any position of the cap 114, the user's tactile sensation is uniform and consistent, and the noises of operation can be effectively reduced.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure, comprising:

a base, comprising a plate, a first limiting unit and a second limiting unit, wherein a first distance is formed between a first sliding portion of the first limiting unit and a bottom surface of the plate, a second distance is formed between the first sliding portion of the first limiting unit and a top surface of the plate, a third distance is formed between a second sliding portion of the second limiting unit and the bottom surface of the plate, and a fourth distance is formed between the second sliding portion of the second limiting unit and the top surface of the plate;

a pivoting structure movably disposed on the base and comprising a first pivoting part and a second pivoting part, wherein the first pivoting part has a connecting shaft, and the second pivoting part has a shaft hole in which the connecting shaft is received and slidable; and a cap disposed on the pivoting structure, wherein the cap has a first pivoting unit and a second pivoting unit, one side of the first pivoting part and one side of the second pivoting part are pivotally connected to the first pivoting unit and the second pivoting unit respectively, and another side of the first pivoting part and another side of the second pivoting part are slidably disposed in the first limiting unit and the second limiting unit through a first sliding shaft of the first pivoting part and a second sliding shaft of the second pivoting part respectively, wherein the first sliding shaft has a first diameter, the second sliding shaft has a second diameter, a size of the first diameter is between the first distance and the second distance, and a size of the second diameter is between the third distance and the fourth distance.

2. The key structure according to claim 1, wherein the plate is located on a plane defined by an X-axis and a Y-axis, and the first limiting unit and the second limiting unit extend towards a positive Z-axis direction from the plate, and the X-axis and the Y-axis are respectively orthogonal with the Z-axis, the first limiting unit has the first sliding portion extended along a positive X-axis direction, and a first receiving space is defined between the first sliding portion and the plate, the first distance is larger than the second distance;

the second limiting unit has the second sliding portion extended along a negative X-axis direction, and a second receiving space is defined between the second sliding portion and the plate, and the third distance is larger than the fourth distance.

3. The key structure according to claim 2, wherein one end of the first pivoting part and one end of the second pivoting part have a first fixing shaft and a second fixing shaft respectively;

the first fixing shaft is pivotally connected to the first pivoting unit, the second fixing shaft is pivotally connected to the second pivoting unit, the first sliding shaft is limited by the first sliding portion and is slidably disposed in the first receiving space, and the second sliding shaft is limited by the second sliding portion and is slidably disposed in the second receiving space.

4. The key structure according to claim 1, wherein the shaft hole is a long slot in which the connecting shaft is movable.

5. The key structure according to claim 1, wherein the first limiting unit and the second limiting unit both have a first height with respect to a bottom surface of the plate, and when the cap moves to a pressing position from a releasing position, a bottom surface of the cap has a second height with respect to the bottom surface of the plate, and the second height is larger than the first height.

6. The key structure according to claim 1, wherein when the cap moves to a pressing position, a portion of the first pivoting unit and the second pivoting unit is substantially lower than a top surface of the plate and buried in the plate.

7. The key structure according to claim 1, further comprising a thin-film circuit board and an elastomer, wherein the thin-film circuit board is disposed on the plate, the thin-film circuit board comprises a switch element, and the elastomer is disposed on the switch element for supporting the cap.

8. The key structure according to claim 1, wherein the key structure is used in a keyboard of an ultra-thin laptop computer.

9. A key structure, comprising:

a base, comprising a plate, a first limiting unit and a second limiting unit, wherein a first distance is formed between a first sliding portion of the first limiting unit and a bottom surface of the plate, a second distance is formed between the first sliding portion of the first limiting unit and a top surface of the plate, a third distance is formed between a second sliding portion of the second limiting unit and the bottom surface of the plate, and a fourth distance is formed between the second sliding portion of the second limiting unit and the top surface of the plate;

a pivoting structure movably disposed on the base and comprising a first pivoting part and a second pivoting part, wherein the first pivoting part has a connecting shaft, and the second pivoting part has a shaft hole engaged with the connecting shaft; and a cap disposed on the pivoting structure, wherein one side of the first pivoting part and one side of the second pivoting part are pivotally connected to the cap respectively, respectively, and another side of the first pivoting part and another side of the second pivoting part have a first sliding shaft and a second sliding shaft slidably disposed in the first limiting unit and the second limiting unit respectively, wherein a portion of the first sliding shaft and a portion of the second sliding shaft are substantially lower than a top surface of the plate; and wherein the first sliding shaft has a first diameter, the second sliding shaft has a second diameter, a size of the first diameter is between the first distance and the second distance, and a size of the second diameter is between the third distance and the fourth distance.

10. The key structure according to claim 9, wherein the plate is located on a plane defined by an X-axis and a Y-axis, and the first limiting unit and the second limiting unit extend towards a positive Z-axis direction from the plate, and the X-axis and the Y-axis are respectively orthogonal with the Z-axis, the first limiting unit has the first sliding portion extended along a positive X-axis direction, and a first receiving space is defined between the first sliding portion and the plate, and the first distance is larger than the second distance;

the second limiting unit has the second sliding portion extended along a negative X-axis direction, and a second receiving space is defined between the second sliding portion and the plate, and the third distance is larger than the fourth distance.

11. The key structure according to claim 10, wherein one end of the first pivoting part and one end of the second pivoting part have a first fixing shaft and a second fixing shaft respectively, and another end of the first pivoting part and another end of the second pivoting part have the first sliding shaft and the second sliding shaft respectively;

the first fixing shaft is pivotally connected to a first pivoting unit of the cap, the second fixing shaft is pivotally connected to a second pivoting unit of the cap, the first sliding shaft is limited by the first sliding portion and is slidably disposed in the first receiving space, and the second sliding shaft is limited by the second sliding portion and is slidably disposed in the second receiving space.

12. The key structure according to claim 9, wherein the shaft hole is a long slot in which the connecting shaft is movable and slidable.

13. The key structure according to claim 9, wherein the first limiting unit and the second limiting unit both have a first height with respect to a bottom surface of the plate, and when the cap moves to the pressing position from a releasing position, a bottom surface of the cap has a second height with respect to the bottom surface of the plate, and the second height is larger than the first height.

14. A key structure, comprising:

a base, comprising a plate, a first limiting unit and a second limiting unit, wherein a first distance is formed between a first sliding portion of the first limiting unit and a bottom surface of the plate, a second distance is formed between the first sliding portion of the first limiting unit and a top surface of the plate, a third distance is formed between a second sliding portion of the second limiting unit and the bottom surface of the plate, and a fourth distance is formed between the second sliding portion of the second limiting unit and the top surface of the plate;

a pivoting structure movably disposed on the base and comprising a first pivoting part and a second pivoting part, wherein the first pivoting part has a connecting shaft, the second pivoting part has a shaft hole engaged with the connecting shaft, the shaft hole having a length larger than a diameter of the connecting shaft for the connecting shaft slidable therein; and a cap disposed on the pivoting structure, wherein the cap has a first pivoting unit and a second pivoting unit, one side of the first pivoting part and one side of the second pivoting part are pivotally connected to the first pivoting unit and the second pivoting unit respectively, and another side of the first pivoting part and another side of the second pivoting part are slidably disposed in the first limiting unit and the second limiting unit respectively;

wherein one end of the first pivoting part and one end of the second pivoting part have a first fixing shaft and a second fixing shaft respectively, and another end of the first pivoting part and another end of the second pivoting part have a first sliding shaft and a second sliding shaft respectively, and wherein the first sliding shaft has a first diameter, the second sliding shaft has a second diameter, a size of the first diameter is between the first distance and the second distance, and a size of the second diameter is between the third distance and the fourth distance.

15. The key structure according to claim 14, wherein the shaft hole is a long slot in which the connecting shaft is movable along an extending direction of the length of the shaft hole.

16. The key structure according to claim 14, wherein the first limiting unit and the second limiting unit both have a first height with respect to a bottom surface of the plate, and when the cap moves to a pressing position from a releasing position, a bottom surface of the cap has a second height with respect to the bottom surface of the plate, and the second height is larger than the first height.

17. The key structure according to claim 14, wherein when the cap moves to a pressing position, a portion of the first pivoting unit and the second pivoting unit is substantially lower than a top surface of the plate and buried in the plate.

* * * * *